US009885359B2

(12) United States Patent
Nagano et al.

(10) Patent No.: US 9,885,359 B2
(45) Date of Patent: Feb. 6, 2018

(54) MOTOR-DRIVEN COMPRESSOR

(71) Applicant: KABUSHIKI KAISHA TOYOTA JIDOSHOKKI, Kariya-shi, Aichi-ken (JP)

(72) Inventors: Hiroki Nagano, Kariya (JP); Tatsushi Mori, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 119 days.

(21) Appl. No.: 14/946,846

(22) Filed: Nov. 20, 2015

(65) Prior Publication Data

US 2016/0153452 A1 Jun. 2, 2016

(30) Foreign Application Priority Data

Nov. 28, 2014 (JP) ..... 2014-241136

(51) Int. Cl.

| | |
|---|---|
| ***F01C 1/344*** | (2006.01) |
| ***F03C 2/30*** | (2006.01) |
| ***F04C 2/344*** | (2006.01) |
| ***F04C 18/324*** | (2006.01) |
| ***F04C 29/12*** | (2006.01) |
| ***F04C 23/00*** | (2006.01) |
| ***F04C 18/344*** | (2006.01) |
| ***F01C 21/10*** | (2006.01) |

(52) U.S. Cl.

CPC ..... *F04C 29/12* (2013.01); *F01C 21/10* (2013.01); *F04C 18/3441* (2013.01); *F04C 23/008* (2013.01); *F04C 2240/30* (2013.01)

(58) Field of Classification Search

CPC ..... F04C 29/12; F01C 21/10
USPC ..... 418/259, 266, 268, 133, 134, 148, 236, 418/238

See application file for complete search history.

(56) References Cited

U.S. PATENT DOCUMENTS

| | | | | |
|---|---|---|---|---|
| 7,563,081 | B2 | 7/2009 | Yoda et al. | |
| 2005/0287019 | A1 | 12/2005 | Yoda et al. | |
| 2010/0074773 | A1* | 3/2010 | Watanabe | F01C 21/10 417/410.3 |

FOREIGN PATENT DOCUMENTS

| | | | |
|---|---|---|---|
| JP | 2006-009688 | A | 1/2006 |
| JP | 2010-038014 | A | 2/2010 |

* cited by examiner

*Primary Examiner* — Mark Laurenzi
*Assistant Examiner* — Deming Wan
(74) *Attorney, Agent, or Firm* — Sughrue Mion, PLLC

(57) ABSTRACT

Provided is a motor-driven compressor capable of realizing reduction in manufacturing costs. A compression mechanism of the motor-driven compressor according to the present invention includes a rotor rotatable by a rotation shaft and provided with a plurality of vane grooves, a plurality of vanes disposed advanceably and retractably in the respective vane grooves, a cup member formed into a bottomed cylindrical shape and enclosing the rotor, and a side plate closing an opening of the cup member The contour of the compressor is formed by a first housing and a second housing, and a suction pressure region in the first housing is hermetically closed from outside at a position where the first housing and the second housing are joined together.

2 Claims, 4 Drawing Sheets

MOTOR-DRIVEN COMPRESSOR

TECHNICAL FIELD

The present invention relates to a motor-driven compressor.

BACKGROUND ART

Conventional motor-driven compressors (hereinafter simply referred to as compressors) are disclosed in Japanese Patent Laid-Open Nos. 2006-9688 and 2010-38014.

The compressor disclosed in Japanese Patent Laid-Open No. 2006-9688 comprises a rotation shaft, a motor mechanism capable of rotating the rotation shaft, a front housing member accommodating the motor mechanism, a rear housing member closing an opening of the front housing member, and a compression mechanism fixed to the front and rear housing members. The front housing member includes a suction pressure region, and the rear housing member includes a discharge pressure region.

The compression mechanism of Japanese Patent Laid-Open No. 2006-9688 includes a rotor, five vanes, a cylinder formed into a cylindrical shape and enclosing the rotor, a front side block, and a rear side block. The rotor is rotatable by the rotation shaft and provided with five vane grooves. The vanes are disposed advanceably and retractably in the respective vane grooves. The front side block and the rear side block close opposite ends of the cylinder. The cylinder and the front and rear side blocks form a cylinder chamber.

The compressor disclosed in Japanese Patent Laid-Open No. 2010-38014 comprises a rotation shaft, a motor mechanism capable of rotating the rotation shaft, a motor housing member accommodating the motor mechanism, a compressor housing member closing an opening of the motor housing member, a front housing member fixed to the compressor housing member, and a compression mechanism enclosed in the compressor housing member. The motor housing member includes a discharge pressure region, and the front housing member includes a suction pressure region.

The compression mechanism of Japanese Patent Laid-Open No. 2010-38014 includes a rotor, plural vanes, a cylinder block formed into a cylindrical shape and enclosing the rotor, a rear side block formed integrally with the compressor housing member and closing one end of the cylinder block, and a front side block closing the other end of the cylinder block. The rotor is rotatable by the rotation shaft and provided with plural vane grooves. The vanes are disposed advanceably and retractably in the respective vane grooves. The cylinder block and the front and rear side blocks form a cylinder chamber.

According to the compressor of Japanese Patent Laid-Open No. 2006-9688, however, because the suction pressure region in the front housing member is formed by fixing a partition wall member, which is a different member from the cylinder, to the front and rear housing members, assembly work is complicated. According to the compressor of Japanese Patent Laid-Open No. 2010-38014, because the front and rear side blocks are interposed between the motor housing member and the front housing member, assembly work is complicated. Furthermore, in these compressors, due to a large number of components, high costs are required for machining, managing, and assembling individual components, and besides, it is necessary to increase the number of sealing positions or employ seals with high pressure tightness in order to secure sealing capability. Consequently, it is difficult to reduce manufacturing costs in these compressors.

The present invention has been made in view of the conventional circumstances described above, and it is an object of the invention to provide a motor-driven compressor capable of realizing reduction in manufacturing costs.

SUMMARY OF THE INVENTION

A motor-driven compressor according to the present invention comprises:

a rotation shaft;

a motor mechanism capable of rotating the rotation shaft;

a first housing formed into a bottomed cylindrical shape and accommodating the motor mechanism, the first housing being provided with an inlet port and including a suction pressure region;

a second housing joined to an open side of the first housing, the second housing being provided with an outlet port and including a discharge pressure region; and a compression mechanism fixed to and supported by the second housing so as to partition the suction pressure region from the discharge pressure region, the compression mechanism being driven by the rotation shaft and including at least one compression chamber. The compression chamber is connected to the suction pressure region and the discharge pressure region and configured such that refrigerating gas sucked into the suction pressure region is compressed in the compression chamber and discharged to the discharge pressure region. The contour of the compressor is formed by the first housing and the second housing. The suction pressure region in the first housing is hermetically closed, or sealed from outside at a position where the first housing and the second housing are joined together.

DETAILED DESCRIPTION OF EXEMPLARY EMBODIMENTS

The first and second embodiments which embody the present invention will be described below with reference to the drawings.

(First Embodiment)

Figure 1:
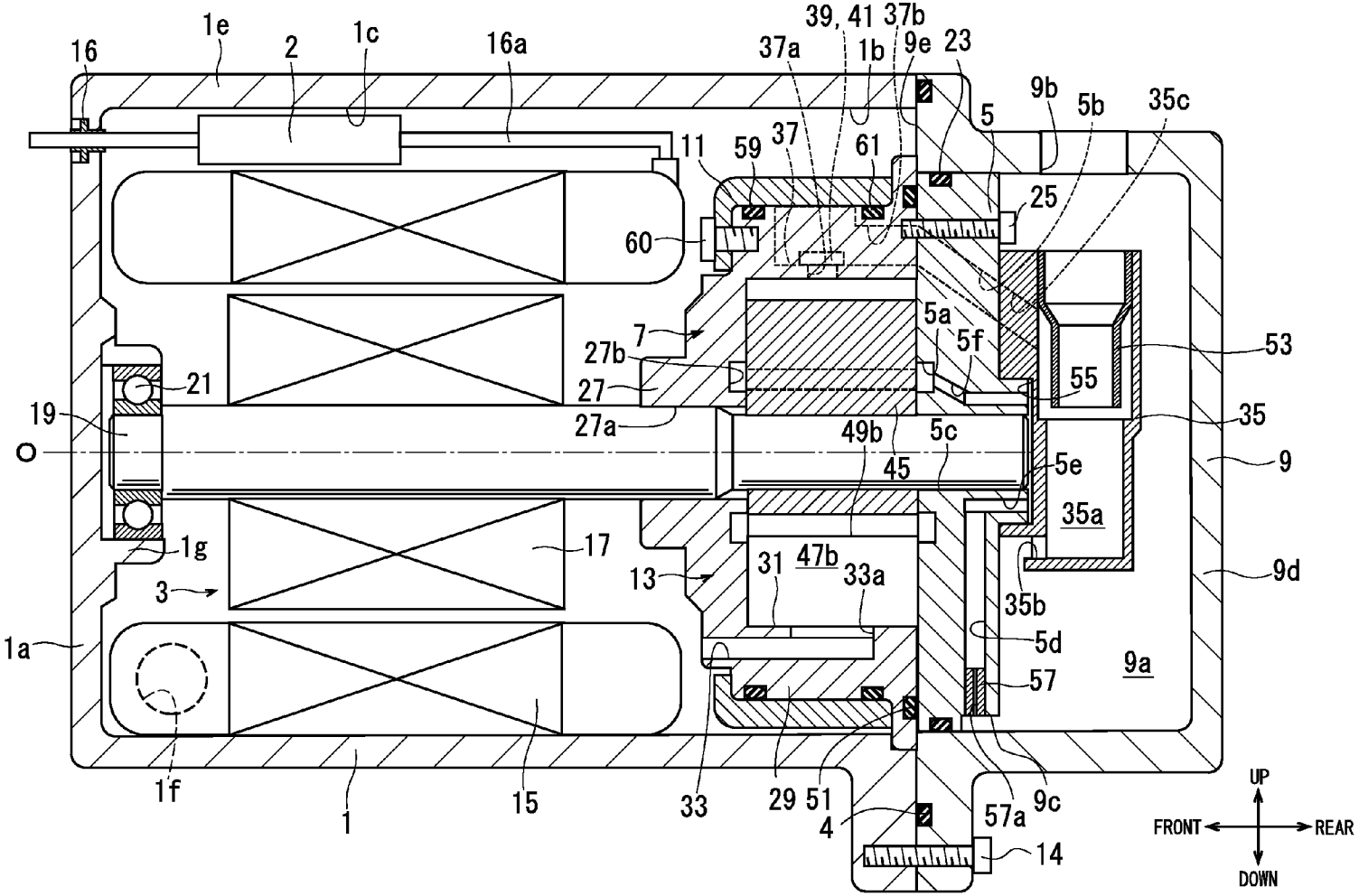
FIG. 1 is a sectional view of a motor-driven compressor according to a first embodiment taken in an axial direction of a rotation shaft.

As shown in FIG. 1, a motor-driven compressor (hereinafter simply referred to as a compressor) according to the first embodiment comprises a rotation shaft 19, a motor mechanism 3, a first housing 1, a second housing 9, and a compression mechanism 13. Hereinafter, in FIG. 1, the side on which the first housing 1 is disposed is defined as the front side of the compressor, while the side on which the second housing 9 is disposed is defined as the rear side of the compressor.

Figure 2:
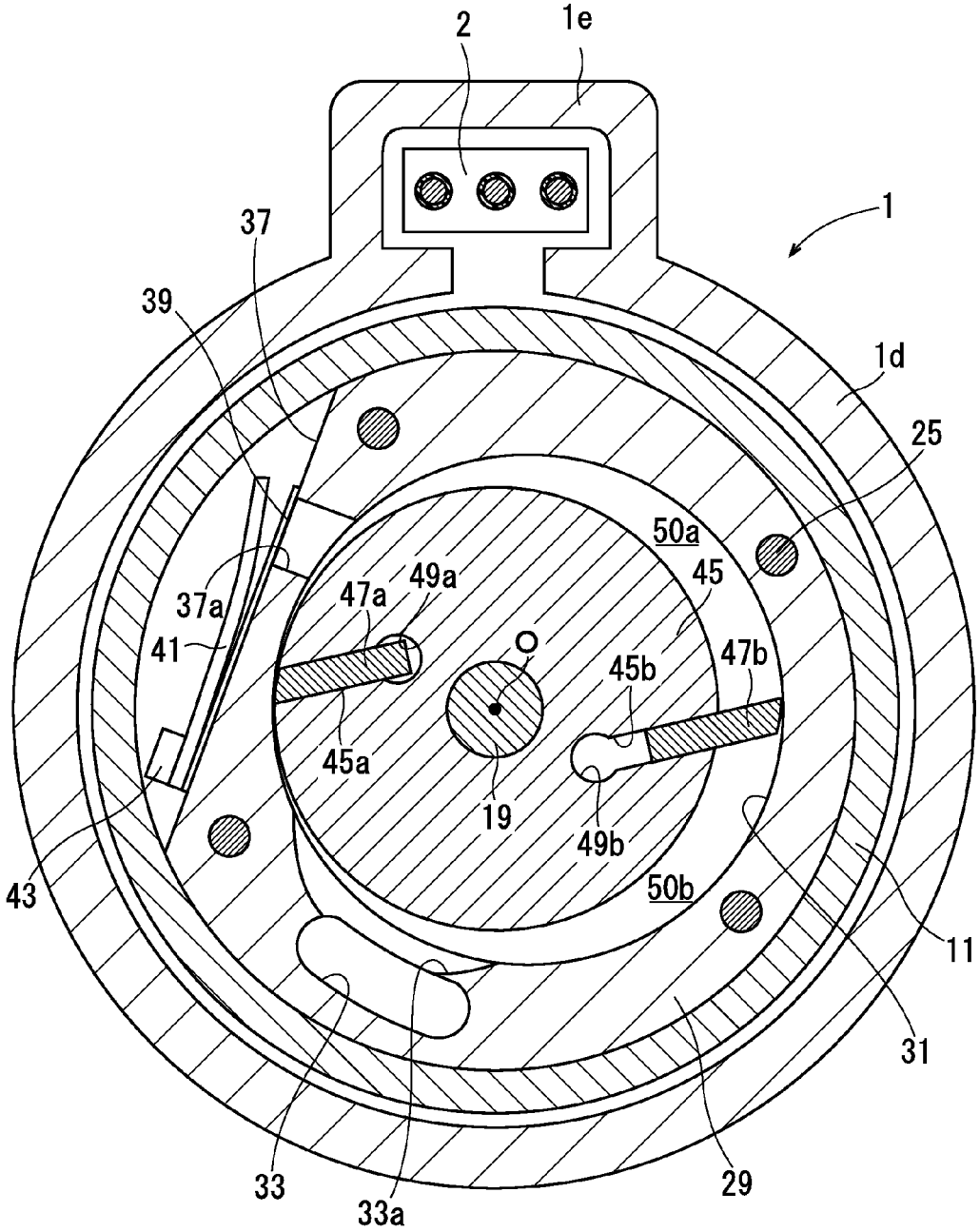
FIG. 2 is a sectional view of the motor-driven compressor according to the first embodiment taken in a direction perpendicular to the axial direction.

The first housing 1 is formed into a bottomed cylindrical shape and extends rearward from the front side of the compressor in an axial direction of the rotation shaft 19, i.e. along an axis 0 of the rotation shaft 19. The front end of the first housing 1 is closed by a bottom wall 1*a*, and the rear end thereof is provided with an opening 1*b*. The first housing 1 includes a motor chamber 1*c*, which serves as a suction pressure region. As shown in FIG. 2, the first housing 1 includes a cylindrical portion 1*d* formed into a cylindrical shape and a bulging portion 1*e* bulging outward from the cylindrical portion 1*d*. As shown in FIG. 1, the first housing 1 is provided with an inlet port 1*f*, through which the motor chamber 1*c* communicates with outside. The inlet port 1*f* is connected to an evaporator of a vehicle air-conditioning apparatus via piping.

The motor mechanism 3 is disposed in the motor chamber 1*c* and includes a stator 15 and a motor rotor 17. The stator 15 is fixed to the inner circumferential surface of the first housing 1. A hermetic terminal 16 for maintaining the motor chamber 1*c* in a hermetic state is provided in parallel to the axial direction at the bulging portion 1*e* of the first housing 1. The outer end of the hermetic terminal 16 is connected to an electric power supply device (not shown), and the inner end of the hermetic terminal 16 is connected to the stator 15 by lead wires 16*a* via a cluster block 2. The motor rotor 17, through which the rotation shaft 19 extending in the axial direction is inserted, is disposed in the stator 15. A shaft support portion 1*g* is formed on the bottom wall 1*a* of the first housing 1 so as to project in the axial direction, and a bearing device 21 is provided in the shaft support portion 1*g*. The front end portion of the rotation shaft 19 is supported by the bearing device 21.

The second housing 9 is fixed to the rear end of the first housing 1 with plural bolts 14. The second housing 9 is formed into a bottomed cylindrical shape. The rear end of the second housing 9 is closed by a bottom wall 9*d*, and the front end thereof is provided with an opening 9*e*. The periphery of the opening 9*e* of the second housing 9 abuts the periphery of the opening 1*b* of the first housing 1 with an O-ring 4 interposed therebetween, and thereby, the first housing 1 and the second housing 9 are closed. A flat-shaped side plate 5, which extends radially in a direction perpendicular to the axial direction, is fitted into the opening 9*e* of the second housing 9. An O-ring 23 is provided between the outer circumferential surface of the side plate 5 and the inner circumferential surface of the second housing 9. A block 35 is fixed to the side plate 5.

A cup member 7 formed into a bottomed cylindrical shape is fixed to the front face of the side plate 5 with plural bolts 25. The cup member 7 includes a bottom portion 27 and a cylinder forming portion 29. The bottom portion 27 is disposed closer to the motor rotor 17 than the cylinder forming portion 29 and extends in the radial direction. The bottom portion 27 is provided with a shaft hole 27*a*, through which the rotation shaft 19 is inserted. Plating (not shown) is applied to the shaft hole 27*a* in order to enhance smooth rotational sliding of the rotation shaft 19.

The cylinder forming portion 29 is integrally formed with the bottom portion 27 and extends cylindrically in the axial direction. By fixing the cup member 7 to the side plate 5 with the bolts 25, a cylinder chamber 31 is formed inside the cup member 7. As shown in FIG. 2, the cross section of the cylinder chamber 31 taken in a direction perpendicular to the axial direction has a perfectly round shape. The axis of the cylinder chamber 31 is offset from the axis O. Plating (not shown) is applied to the inner surfaces at the front and rear ends of the cylinder chamber 31 and the inner circumferential surface of the cylinder chamber 31 in order to enhance smooth rotational sliding of a rotor 45 and vanes 47*a* and 47*b*, which will be described later.

Also, as shown in FIG. 1, a suction passage 33, which opens in the axial direction and communicates with the motor chamber 1*c*, is formed through the bottom portion 27. The suction passage 33 extends in the axial direction in the cylinder forming portion 29 and, as shown in FIG. 2, communicates with the cylinder chamber 31 via a suction port 33*a*, which is provided in a recessed manner in the cylinder forming portion 29.

Figure 3:
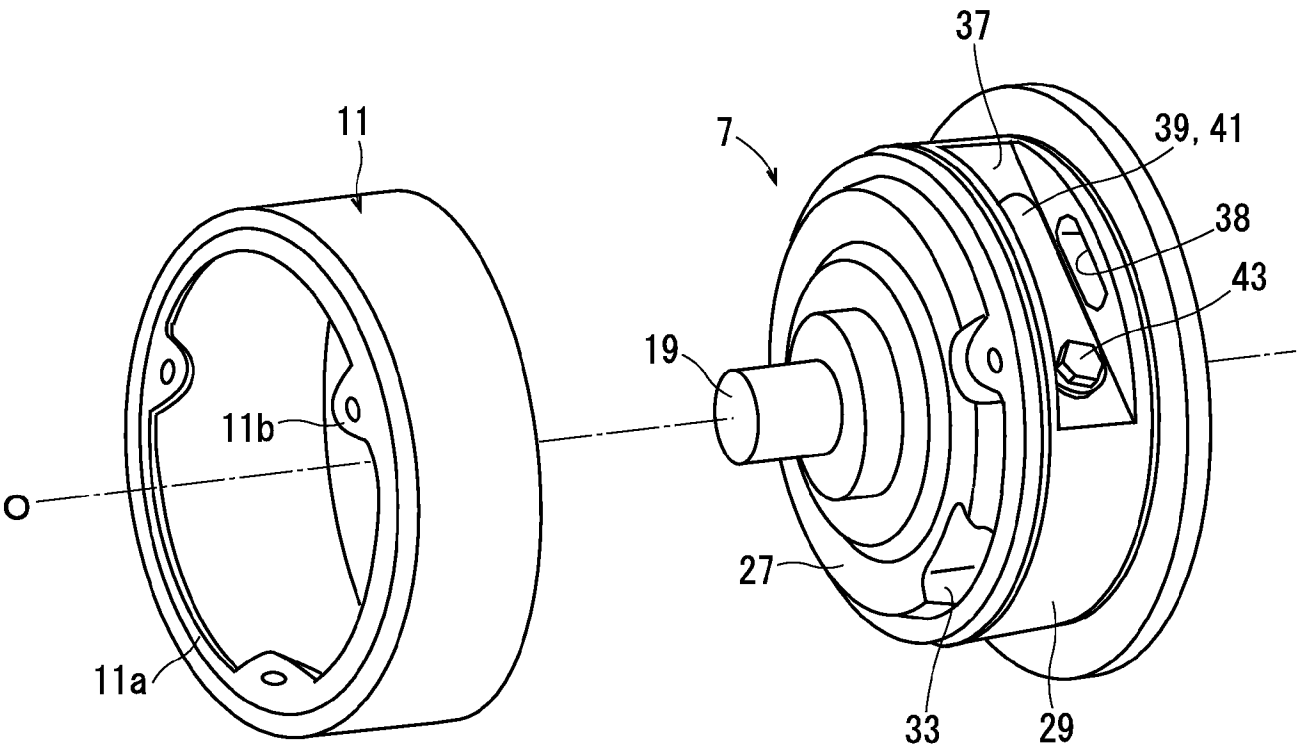
FIG. 3 is an exploded perspective view showing a cup member and a cover member of the motor-driven compressor according to the first embodiment.

As shown in FIG. 3, a discharge pressure space 37 is provided in a recessed manner in the cylinder forming portion 29 so as to open to the outer circumferential side. As shown in FIGS. 1 and 2, the discharge pressure space 37 communicates with the cylinder chamber 31 via a discharge port 37*a*, which is formed through the cylinder forming portion 29. In the discharge pressure space 37, a discharge reed valve 39, which opens and closes the discharge port 37*a*, and a retainer 41, which regulates an opening degree of the discharge reed valve 39, are fixed to the cylinder forming portion 29 with a bolt 43. The discharge pressure space 37 includes a discharge passage 37*b* communicating with an oil separation chamber 35*a*, which will be described later.

The rotor 45 is provided in the cylinder chamber 31 so as to be rotatable by the rotation shaft 19. The rotor 45 is press-fitted to the rotation shaft 19 or coupled to the rotation shaft 19 with a key. The cross section of the rotor 45 taken in a direction perpendicular to the axial direction has a perfectly round shape. The axis of the rotor 45 coincides with the axis O. As shown in FIG. 2, the rotor 45 is provided with two vane grooves 45*a* and 45*b*. The vane grooves 45*a* and 45*b* are parallel to an imaginary reference plane on which the axis 0 lies. The vanes 47*a* and 47*b*, which are formed into a flat-plate shape, are disposed advanceably and retractably in the respective vane grooves 45*a* and 45*b*. The spaces surrounded by the bottom faces of the vanes 47*a* and 47*b* and the vane grooves 45*a* and 45*b* are defined as back pressure chambers 49*a* and 49*b*, respectively. Two compression chambers 50*a* and 50*b* are formed by the front surface of the cylinder chamber 31, the inner circumferential surface of the cylinder chamber 31, and the rear surface of the cylinder chamber 31 as well as the outer circumferential surface of the rotor 45 and the respective vanes 47*a* and 47*b*.

As shown in FIG. 1, an annular groove 27*b* is provided in a recessed manner around the axis O at the rear face of the bottom portion 27 of the cup member 7. Furthermore, an annular groove 5*a* is provided in a recessed manner around the axis O at the front face of the side plate 5 so as to face the annular groove 27*b* in the front-rear direction.

An O-ring 51 is provided between the cylinder forming portion 29 and the front face of the side plate 5. A discharge chamber 9*a* is formed between the second housing 9 and the side plate 5. The discharge chamber 9*a* serves as a discharge pressure region. The second housing 9 is provided with an outlet port 9*b*, through which the discharge chamber 9*a* communicates with outside. The outlet port 9*b* is connected to a condenser of the vehicle air-conditioning apparatus via piping.

The oil separation chamber 35*a* is formed into a columnar shape and extends perpendicularly to the axial direction in the block 35. A cylindrical member 53 formed into a cylindrical shape is fixed to the oil separation chamber 35*a*. The upper end of the cylindrical member 53 opens to the discharge chamber 9*a*, and the lower end of the oil separation chamber 35*a* opens to the discharge chamber 9*a* through an oil outlet 35*b*. Passages 5*b* and 35*c* are formed through the side plate 5 and the block 35 so as to allow the discharge passage 37*b* to communicate with the oil separation chamber 35*a*. The oil separation chamber 35*a* and the cylindrical member 53 constitute an oil separator.

The side plate 5 is provided with a shaft hole 5*c*, through which the rotation shaft 19 is inserted. Plating (not shown) is applied to the shaft hole 5*c* in order to enhance smooth rotational sliding of the rotation shaft 19. The rear end portion of the rotation shaft 19 is supported by the shaft hole 5*c*. In this manner, both ends of the rotation shaft 19 are supported by the bottom wall 1*a* of the first housing 1 and the shaft hole 5*c* of the side plate 5, respectively, and thereby the rotation shaft 19 is suitably rotatable.

An oil supply chamber 55 is formed between the side plate 5 and the block 35. The oil supply chamber 55 communicates with the shaft hole 5*c*. An oil groove 9*c* is provided in a recessed manner at the bottom portion of the side plate 5. The oil groove 9*c* communicates with the discharge chamber 9*a*. A first passage 5*d* is formed in the side plate 5. The first passage 5*d* communicates with the oil groove 9*c* and extends upward so as to approach the axis O. A second passage 5*e* and a third passage 5*f* are also formed in the side plate 5. The second passage 5*e* allows the oil supply chamber 55 to communicate with the upper end of the first passage 5*d*, and the third passage 5*f* allows the oil supply chamber 55 to communicate with the annular groove 5*a*. A throttle member 57 is fitted into the first passage 5*d*. The throttle member 57 includes a throttle passage 57*a* extending therethrough, the diameter of which is smaller than that of the first passage 5*d*.

As shown in FIG. 3, a cover member 11 is provided on the outer circumference of the cup member 7. The cover member 11 has an inner flange 11*a* on which three fixing pieces 11*b* are formed. As shown in FIG. 1, the cover member 11 is fixed to the cup member 7 by screwing three bolts 60 into the respective fixing pieces 11*b* in the axial direction. Between the outer circumferential surface of the cylinder forming portion 29 of the cup member 7 and the inner circumferential surface of the cover member 11, O-rings 59 and 61 are provided. The O-rings 59 and 61 are disposed in the front-rear direction with the discharge pressure space 37 interposed therebetween. In this way, as shown in FIG. 2, the cover member 11 surrounds the cylinder forming portion 29 of the cup member 7 so as to separate the discharge pressure space 37 from the motor chamber 1*c*. The rotor 45, the vanes 47*a* and 47*b*, the cup member 7, the side plate 5, and the cover member 11 constitute the compression mechanism 13.

In this compressor, when electric power is supplied to the stator 15 shown in FIG. 1, the motor mechanism 3 starts operation and the rotation shaft 19 rotates around the axis O. The compression mechanism 13 then operates and the rotor 45 rotates in the cylinder chamber 31, which is formed by the cup member 7 and the side plate 5. During the rotation of the rotor 45, the volume of the respective compression chambers 50*a* and 50*b* increases and decreases repeatedly. Therefore, in the compression chambers 50*a* and 50*b*, a suction phase for introducing low-pressure refrigerating gas from the motor chamber 1*c* via the suction passage 33 and the suction port 33*a* takes place. This suction phase is followed by a compression phase in which the refrigerating gas is compressed in the compression chambers 50*a* and 50*b*. The compression phase is then followed by a discharge phase in which the compressed high-pressure refrigerating gas in the compression chambers 50*a* and 50*b* is discharged to the discharge chamber 9*a* through the discharge port 37*a*, the discharge pressure space 37, and the passages 5*b* and 35*c*. In this way, air-conditioning of a vehicle interior is carried out.

At this time, due to a centrifugal force, lubricating oil is separated from the high-pressure refrigerating gas discharged into the oil separation chamber 35*a* through the passages 5*b* and 35*c*. The lubricating oil is accumulated in the discharge chamber 9*a*. Then, due to a high pressure in the discharge chamber 9*a*, the lubricating oil is supplied to the annular groove 5*a*, flowing through the oil groove 9*c*, the throttle passage 57*a* of the throttle member 57, the first passage 5*d*, the second passage 5*e*, the oil supply chamber 55, and the third passage 5*f*. Because the annular groove 5*a* communicates with the back pressure chambers 49*a* and 49*b*, back pressure is applied to the vanes 47*a* and 47*b*. Therefore, the vanes 47*a* and 47*b* are suitably urged against the inner circumferential surface of the cylinder chamber 31, and thereby compression work is performed with high efficiency.

In this compressor, since the compression mechanism 13 is fixed as a unit to the second housing 9, not to the first housing 1, assembly work is easy. That is, it is sufficient to merely fix the compression mechanism 13 to the second housing 9 and then assemble the first housing 1. The motor mechanism 3 may be assembled to the compression mechanism 13 via the rotation shaft 19 before the compression mechanism 13 is fixed to the second housing 9, or, the compression mechanism 13 may be fixed to the second housing 9 first, and then the motor mechanism 3, and thereafter the first housing 1, may be assembled.

Furthermore, since this compressor comprises less number of components, it is possible to reduce the costs for machining, managing, and assembling individual components. In addition, since the compression mechanism 13 is not exposed outside and the suction pressure region with low pressure is disposed at the position where the first housing 1 and the second housing 9 are joined together, external leakage of the refrigerating gas from the compression mechanism 13 can be easily sealed with a simple structure.

More specifically, in this compressor, the compression mechanism 13 includes the cup member 7 formed into a bottomed cylindrical shape, and by simply fixing the cup member 7 to the side plate 5, i.e., to a single piece, the cylinder chamber 31 is formed therein. Therefore, less number of components needs to be fixed to the first housing 1 as compared with conventional cases. Therefore, it is relatively easy to maintain the cylinder chamber 31 in a hermetic state against the motor chamber 1*c*. Furthermore, since this compressor comprises less number of components, it is possible to reduce the costs for machining, managing, and assembling individual components.

In this compressor, since the inside of the first housing 1 is partitioned by the cup member 7, it is possible to dispose the suction pressure region at the position where the first housing 1 and the second housing 9 are joined together. Therefore, leakage of the refrigerating gas to the outside of the compressor is less likely to occur, and it is less necessary to provide a high-pressure seal such as a gasket.

Hence, this compressor is capable of realizing reduction in manufacturing costs.

Furthermore, in this compressor, since the cover member 11 is provided on the outer circumference of the cup member 7, the discharge pressure space 37 of the cylinder forming portion 29 is able to communicate with the discharge chamber 9*a* in a state of being isolated from the motor chamber 1*c*, i.e., the suction pressure region, due to the cover member 11. Therefore, even when the cylindrical portion 1*d* of the first housing 1 may not be perfectly round, the motor chamber 1*c* in the first housing 1 is easily usable as the suction pressure region.

Furthermore, in this compressor, since the discharge pressure space 37 is closed by the cover member 11, vibration and noise generated by the discharge reed valve 39 can be prevented from being transmitted outward.

Furthermore, in this compressor, the first housing 1 does not have a perfectly round shape due to the necessity for wiring, which is inherent in motor-driven compressors. In such a compressor, it is difficult to separate a discharge chamber from a motor chamber with a flat-plate wall, and it is also difficult to seal clearances so as to prevent leakage of refrigerating gas from around the wall. However, these difficulties can be easily overcome by employing the cup member 7 of the present invention.

Here, if it is attempted to cover a part of the outer circumference of the cup member 7 by the cover member 11 so as to partition the discharge pressure space 37, a certain space in the radial direction will be needed for fastening bolts and the size of the compressor will be increased in the radial direction. In this respect, since the cover member 11 of this compressor is fastened to the cup member 7 with the bolts 60 extending in the axial direction, it is possible to arrange the bolts 60 such that the heads thereof are disposed in a space between the stator 15 of the motor mechanism 3 and the cup member 7. Therefore, in this compressor, the suction pressure region and the discharge pressure region can be separated from each other without increasing the size of the compressor in the radial direction or the axial direction.

(Second Embodiment)

Figure 4:
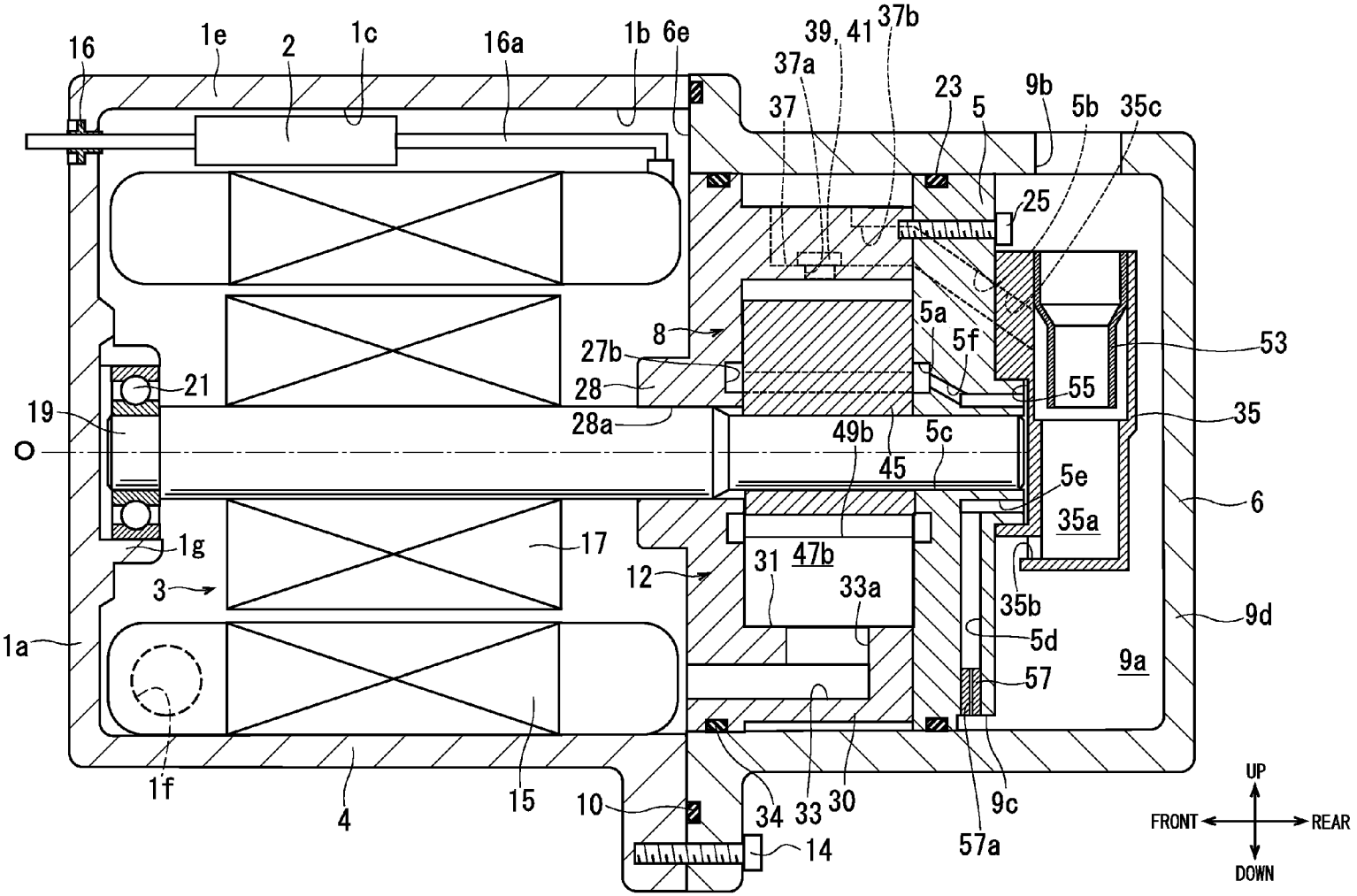
FIG. 4 is a sectional view of a motor-driven compressor according to a second embodiment taken in an axial direction of a rotation shaft.

As shown in FIG. 4, a compressor according to the second embodiment employs a first housing 4 and a second housing 6. The length of the first housing 4 in the axial direction is shorter than that of the first housing 1 in the first embodiment. The length of the second housing 6 in the axial direction is longer than that of the second housing 9 in the first embodiment. An O-ring 10 is provided between the first housing 4 and the second housing 6.

A compression mechanism 12 is fitted into the second housing 6. The compression mechanism 12 employs a cup member 8 formed into a cylindrical shape. The cup member 8 is fixed to the front face of the side plate 5 with plural bolts 25. The cup member 8 includes a bottom portion 28 and a cylinder forming portion 30. The bottom portion 28 is disposed closer to the motor chamber 1*c* than the cylindrical forming portion 30 and extends in the radial direction. An O-ring 34 is provided between the bottom portion 28 and the inner circumferential surface of the second housing 6. The bottom portion 28 is provided with a shaft hole 28*a*, through which the rotation shaft 19 is inserted. A discharge pressure space 37 is provided in a recessed manner in the cylinder forming portion 30 so as to open to the inside of the second housing 6. The rotor 45, the vanes 47*a* and 47*b*, the cup member 8, and the side plate 5 constitute the compression mechanism 12. The other components are the same as those in the first embodiment.

Also in this compressor, by employing the cup member 8, it is possible to exhibit the operational effects of the present invention except for those exhibited due to the cover member 11 in the first embodiment. Furthermore, since the cover member 11 in the first embodiment can be eliminated in this compressor, it is possible to realize further reduction in manufacturing costs.

Although the present invention has been described above by referring to the first and second embodiments, needless to say, the present invention is not limited to the first and second embodiments and may be modified as appropriate without departing from the gist of the invention.

For example, it is sufficient if the shaft holes 27*a* and 28*a* at the bottom portions 27 and 28 of the cup members 7 and 8 are configured so as to be able to maintain the hermetic state as much as possible with respect to the rotation shaft 19. Furthermore, instead of plating the shaft holes 27*a*, 28*a* and 5*c*, a slide bearing or a roller bearing may be provided between the rotation shaft 19 and the shaft holes 27*a*, 28*a* and 5*c*.

The invention claimed is:

1. A motor-driven compressor comprising:

a rotation shaft;

a motor mechanism capable of rotating the rotation shaft;

a first housing formed into a bottomed cylindrical shape and accommodating the motor mechanism, the first housing being provided with an inlet port and including a suction pressure region;

a second housing joined to an open side of the first housing, the second housing being provided with an outlet port and including a discharge pressure region; and a compression mechanism fixed to and supported by the first and second housings so as to partition the suction pressure region from the discharge pressure region, the compression mechanism being driven by the rotation shaft and including at least one compression chamber, wherein the at least one compression chamber is connected to the suction pressure region and the discharge pressure region and configured such that refrigerating gas sucked into the suction pressure region is compressed in the compression chamber and discharged to the discharge pressure region, the contour of the compressor is formed by the first housing and the second housing, and the suction pressure region in the first housing is hermetically closed from outside at a position where the first housing and the second housing are joined together, wherein the compression mechanism includes: a rotor rotatable by the rotation shaft and provided with a plurality of vane grooves; a plurality of vanes disposed advanceably and retractably in the respective vane grooves; a cup member formed into a bottomed cylindrical shape and enclosing the rotor; and a side plate closing an opening of the cup member, a plurality of the compression chambers are formed by the rotor, the vanes, the cup member, and the side plate, and a cover member is provided on an outer circumference of the cup member so as to form a discharge pressure space inside the cover member, the cover member being configured to guide the refrigerant gas discharged into the discharge pressure space to the discharge pressure region.

2. The motor-driven compressor according to claim 1, wherein the side plate is provided with a shaft hole extending along an axis of the rotation shaft, and the rotation shaft is supported by the shaft hole and a bottom wall of the first housing.

* * * * *